US005413249A

United States Patent [19]

Chigira

[11] Patent Number: 5,413,249

[45] Date of Patent: May 9, 1995

[54] AUTOMATIC VENDING MACHINE

[75] Inventor: Noboru Chigira, Shimooshi, Japan

[73] Assignee: Sanyo Electric Co., Ltd., Moriguchi, Japan

[21] Appl. No.: 198,903

[22] Filed: Feb. 18, 1994

[30] Foreign Application Priority Data

Feb. 26, 1993 [JP] Japan ..... 5-038565

[51] Int. Cl.[6] ..... B67D 5/62

[52] U.S. Cl. ..... 222/55; 222/129.4; 222/146.6; 62/354

[58] Field of Search ..... 62/354; 222/55, 63, 222/129.1, 129.3, 129.4, 146.4

[56] References Cited

U.S. PATENT DOCUMENTS

| | | | |
|---|---|---|---|
| 3,059,450 | 10/1962 | Mueller et al. | 222/146.6 X |
| 3,256,710 | 6/1966 | Dedricks et al. | 62/354 X |
| 3,378,170 | 4/1968 | Reynolds | 222/129.4 |
| 3,496,734 | 2/1970 | Schumacher | 62/354 X |
| 4,417,671 | 11/1983 | Kawasaki et al. | 222/63 X |
| 4,426,851 | 1/1984 | Neumann | 62/354 X |
| 4,771,609 | 9/1988 | Funabashi | 62/354 X |
| 5,219,008 | 6/1993 | Shannon | 222/63 X |

FOREIGN PATENT DOCUMENTS

| | | | |
|---|---|---|---|
| 0033446 | 3/1978 | Japan | 62/354 |
| 199885 | 12/1987 | Japan . | |

*Primary Examiner*—Robert J. Oberleitner
*Assistant Examiner*—Kenneth Bomberg
*Attorney, Agent, or Firm*—Darby & Darby

[57] ABSTRACT

An automatic vending machine for supplying a drink in a cup. A predetermined amount of ice is supplied from an ice making machine with rapidity and stability. The vending machine has: an ice making machine; an ice chute for feeding the ice discharged from the ice making machine into a cup; a sensor for detecting the ice passing through the ice chute and outputting an ice passage signal; and a controller for detecting the amount of ice discharged from the ice making machine and controlling the ice discharging operation of the ice making machine on the basis of the ice passage signal.

9 Claims, 5 Drawing Sheets

AUTOMATIC VENDING MACHINE

BACKGROUND OF THE INVENTION

The present invention relates to what is called a cupped drink automatic vending machine for vending a drink such as iced coffee which is put into a cup when a predetermined coin or bill is inserted into a slit.

A conventional cupped drink automatic vending machine is provided therewithin with a cup feeder, a plurality of material feeders accommodating materials such as coffee, milk and sugar, a diluent feeder for feeding a diluent such as water and hot water, and an ice feeder for feeding ice, as described in, for example, Japanese Utility Model Laid-Open No. Sho 62-199885 (G07F13/06).

When a customer inserts a coin or a bill into a slit and a drink is selected, the vending operation is started. A cup is dropped from the cup feeder and transferred by a transferring means to the position where a material is fed. After the material is fed into the cup, the cup is next moved to the position where the dilute is fed. After the dilute is fed, the cup is moved to the position where ice is fed from the ice feeder, and ice is finally put into the cup.

The ice feeder in this type of automatic vending machine is generally composed of an auger ice making machine for producing ice chips. The ice making machine produce ice and stores a predetermined amount of ice in a storage tank. When the cup is transferred to the predetermined position at which ice is supplied during the vending operation, the door for closing the ice discharge port is held open for a predetermined time, so that ice chips are discharged and dropped into the cup through an ice chute.

However, the ice making performance of such an ice making machine is generally about 2 kg/h. If cups of drink are continuously bought, the ice making performance cannot meet the demand. Since an agitator for discharging ice is continuously driven in the storage tank of the ice making machine, when the amount of ice discharged per unit time is small, the edges of ice chips in the storage tank are rounded. In this manner, ice chips are smoothly discharged from the storage tank with a good fluidity.

On the other hand, when the amount of ice discharged per unit time is large, the angular ice chips which have been newly produced are discharged, so that the fluidity of ice chips is bad and they are difficult to discharge from the ice tank.

Consequently, in the system in which a ice discharge port is opened for a predetermined time as in the conventional ice making machine, the amount of ice put into the cup is not constant.

This condition is shown in FIG. 7. In FIG. 7, the abscissa represents the number of cups sold and the ordinate represents the amount of ice discharged from the ice making machine. On the assumption that cups of drink are continuously sold, the amount of ice discharged into each cup is plotted. The target value of the amount of ice discharged is 100 g. The symbol HL represents the allowable upper limit, LL the allowable lower limit and CA the center value of the amount of ice plotted.

As is clear from FIG. 7, in the conventional control of the amount of ice based on a predetermined hour, there is a comparatively large difference in amount of ice between sales, and it is often the case that the amount of ice discharged exceeds the allowable upper limit HL or the allowable lower limit LL. About the time when twelve cups of drink are sold, the ice making performance cannot meet the demand, so that the amount of ice stored in the storage tank reduces and, hence, the amount of ice discharged per unit time reduces. Thereafter, the amount of ice discharged decreases as a whole.

As described above, in the conventional automatic vending machine, the amount of ice discharged from the ice making machine at each sale varies comparatively large. In addition, when cups of drink are continuously sold, the amount of ice discharged begins to reduce at a comparatively early stage. As a result, a lukewarm drink (in the case of iced coffee, etc.) with too small an amount of ice, or a thin drink with too large an amount of ice is inconveniently supplied.

SUMMARY OF THE INVENTION

Accordingly, it is an object of the present invention to eliminate the above-described problems in the related art and to provide an automatic vending machine which enables a predetermined amount of ice to be supplied from an ice making machine to a cup with rapidity and stability.

To achieve this aim, the present invention provides an automatic vending machine for supplying a drink in a cup comprising: an ice making machine; an ice chute for feeding the ice discharged from the ice making machine into a cup; a sensor for detecting the ice passing through the ice chute and outputting an ice passage signal; and a controller for detecting the amount of ice discharged from the ice making machine and controlling the ice discharging operation of the ice making machine on the basis of the ice passage signal.

The above and other objects, features and advantages of the present invention will become clear from the following description of the preferred embodiments thereof, taken in conjunction with the accompanying drawings.

DESCRIPTION OF THE PREFERRED EMBODIMENTS

An automatic vending machine for supplying a drink in a cup is composed of an ice making machine, an ice chute for feeding the ice discharged from the ice making machine into a cup, a sensor for detecting the ice passing through the ice chute and outputting an ice passage signal, and a controller for detecting the amount of ice discharged from the ice making machine and controlling the ice discharging operation of the ice making machine on the basis of the ice passage signal. The ice chips discharged from the ice making machine are fed to the ice chute when the vending operation is started, and the ice chips are then put into a cup through the ice chute. The sensor detects the ice chips passing through the ice chute and outputs an ice passage signal. The controller detects the amount of ice discharged from the ice making machine and controls the ice discharging operation of the ice making machine on the basis of the ice passage signal which is output from the sensor.

In other words, the controller stops the ice discharging operation of the ice making machine when the amount of ice discharged from the ice making machine reaches a predetermined value. In this way, when the fluidity of ice is good and the amount of ice discharged per unit time is large, the discharging time is shortened. On the other hand, when the fluidity of ice is bad and the amount of ice discharged per unit time is small, the discharging time is lengthened. It is therefore possible to constantly discharge a predetermined amount of ice irrespective of the fluidity of ice.

In addition, when cups of drink are continuously sold, even if the amount of ice in the ice storage tank is reduced and the amount of ice discharged per unit time is reduced, since the controller lengthens the time for discharging ice from the ice making machine, it is possible to continue to discharge a predetermined amount of ice for a comparatively long time.

Figure 1:
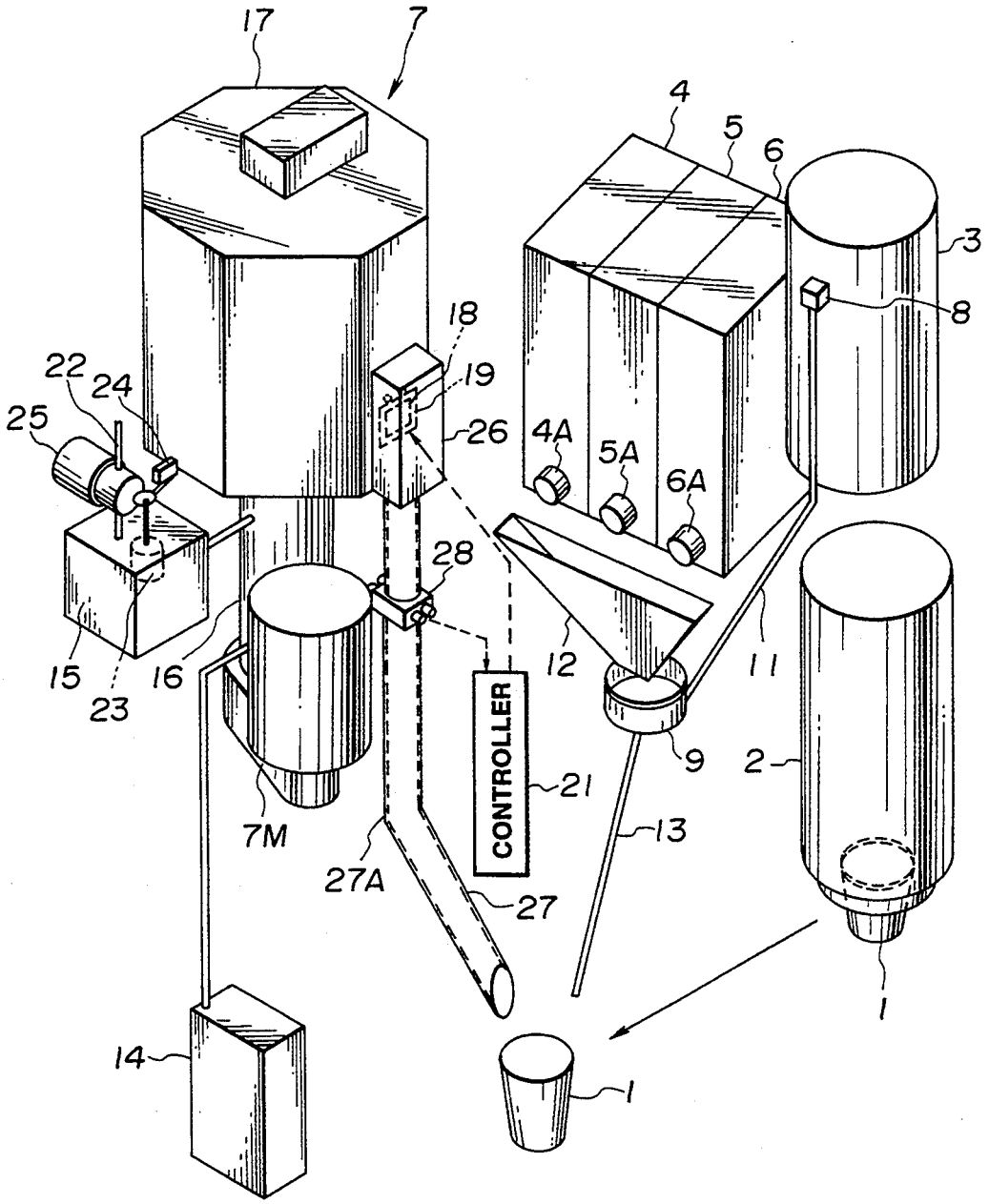
FIG. 1 is a perspective view of each element provided in an embodiment of an automatic vending machine according to the present invention.

An embodiment of an automatic vending machine according to the present invention will now be explained with reference to FIG. 1. As shown in FIG. 1, in the main body of the embodiment, there are provided a cup feeder 2 for feeding a cup 1, a hot water tank 3 provided with a heating means such as a heater (not shown), powder storage boxes 4, 5 and 6 for accommodating and supplying sugar, cream and coffee powders, respectively, and an ice making machine 7.

In this embodiment, the cup feeder 2 accommodates a multiplicity of cups 1 in stacks, and when the vending operation is started, the cup feeder 2 feeds the cup 1 at the lowest end of the stack to a marked position, as indicated by the arrow. A hot water valve 8 is attached to the hot water tank 3, and a hot water supply pipe 11 extends from the hot water valve 8 to a mixing bowl 9. Discharge ports 4A, 5A and 6A open at the lower end of the front surfaces of the powder storage boxes 4, 5 and 6, respectively, and a powder chute 12 is disposed under the discharge ports 4A, 5A and 6A.

The upper end of the powder chute 12 opens under the discharge ports 4A, 5A and 6A and the lower end thereof opens above the mixing bowl 9. A drink supply pipe 13 extends below from the mixing bowl 9, and the lower end of the drink supply pipe 13 is situated above the marked position where the cup 1 is fed.

The ice making machine 7 is what is called an auger ice making machine. The auger ice making machine 7 is cooled by a cooling apparatus 14, and an auger (40) is concentrically inserted into a cooling cylinder 16 to which water for making ice is supplied from a cistern 15. The ice layer produced on the inner surface of the cooling cylinder 16 is scraped upward by the rotation of the auger driven by a motor 7M and compressed so as to produce ice chips. A storage tank 17 stores a predetermined amount of ice chips produced.

In the storage tank 17, an agitator (not shown) is provided which is rotated together with the auger so as to agitate the ice chips in the storage tank 17. An ice discharge port 18 is formed in a side surface of the ice storage tank 17. The ice discharge port 18 can be covered with a door 19, whose closing or opening operation is controlled by a controller 21 composed of a microcomputer.

Into the cistern 15, water for making ice is fed from a water supply pipe 22 which is provided with a water supply solenoid valve 25. The water supply solenoid valve 25 is controlled by a float 23 for detecting the water level and a switch 24 so as to maintaining the level of the water for making ice constant in the cistern 15.

The ice discharge port 18 and the door 19 are covered with a cover 26, and a cylindrical hollow ice chute 27 is extended below from the lower end of the cover 26. In this embodiment, the cover 26 and the ice chute 27 are separately provided. Alternately, the cover 26 may be provided as a part of the ice chute 27 as an integral body.

The lower end of the ice chute 27 is opened above the cup 1 at the marked position, and a sensor 28 for detecting the ice passing (dropping) through the ice chute 27 is attached to the ice chute 27 at a position right under the cover 26.

In this embodiment, the sensor 28 is composed of two pairs of light sensors. The sensor 28 detects a change in the output voltage caused when the ice dropping through the ice chute 27 crosses the optical path between a light emitting portion **28*a* and a light receiving portion 28*b*, and outputs the change to the controller 21** as an ice passage signal.

Since the time for which one ice chip passes the optical path between the light emitting portion **28*a* and the light receiving portion 28*b* is about 3 to 4 ms, the response time of the sensor 28 must be 1/10 or 1/100 of the time, namely, 0.1 ms to 0.01 ms. The light sensor 28** sufficiently satisfies the condition of this speed of response.

A sensor of another system is also usable if the condition of this speed of response is satisfied. As an example of another sensor will be cited a microphone for detecting the sound of an ice chip which drops to and collides against the bent portion **27*a* of the ice chute 27**. By analyzing the sound picked up by the microphone, it is possible to detect the amount of ice discharged.

The operation of this embodiment of an automatic vending machine according to the present invention will now be explained with reference to FIGS. 2 and 3. It is now assumed that a coin or a bill is inserted into a slit by a customer and ice coffee is selected. Since the optimum required amount of ice is 100 g, the controller 21 stores the value 100 g as the required amount of ice. The automatic vending machine starts the vending operation, and the cup 1 is fed to the marked position (not shown) to which a drink is supplied, as described above.

Predetermined amounts of sugar, cream and coffee are discharged from the powder storage boxes 4, 5 and 6, respectively, into the mixing bowl 9 through the powder chute 12. The hot water valve 8 of the hot water tank 3 is opened and hot water is fed into the mixing bowl 9 through the hot water supply pipe 11. These materials are mixed in the mixing bowl 9, and the coffee prepared is put into the cup 1 through the drink supply pipe 13.

The controller 21 opens the door 19 of the ice discharge port 18 so as to start discharging ice from the storage tank 17 of the ice making machine 17. The ice discharged drops into the ice chute 27, passes through the sensor 18 and is fed into the cup 1 from the opening at the lower end of the ice chute 27. The sensor 28 detects the passage of the ice, as described above, and output an ice passage signal IS.

Figure 2:
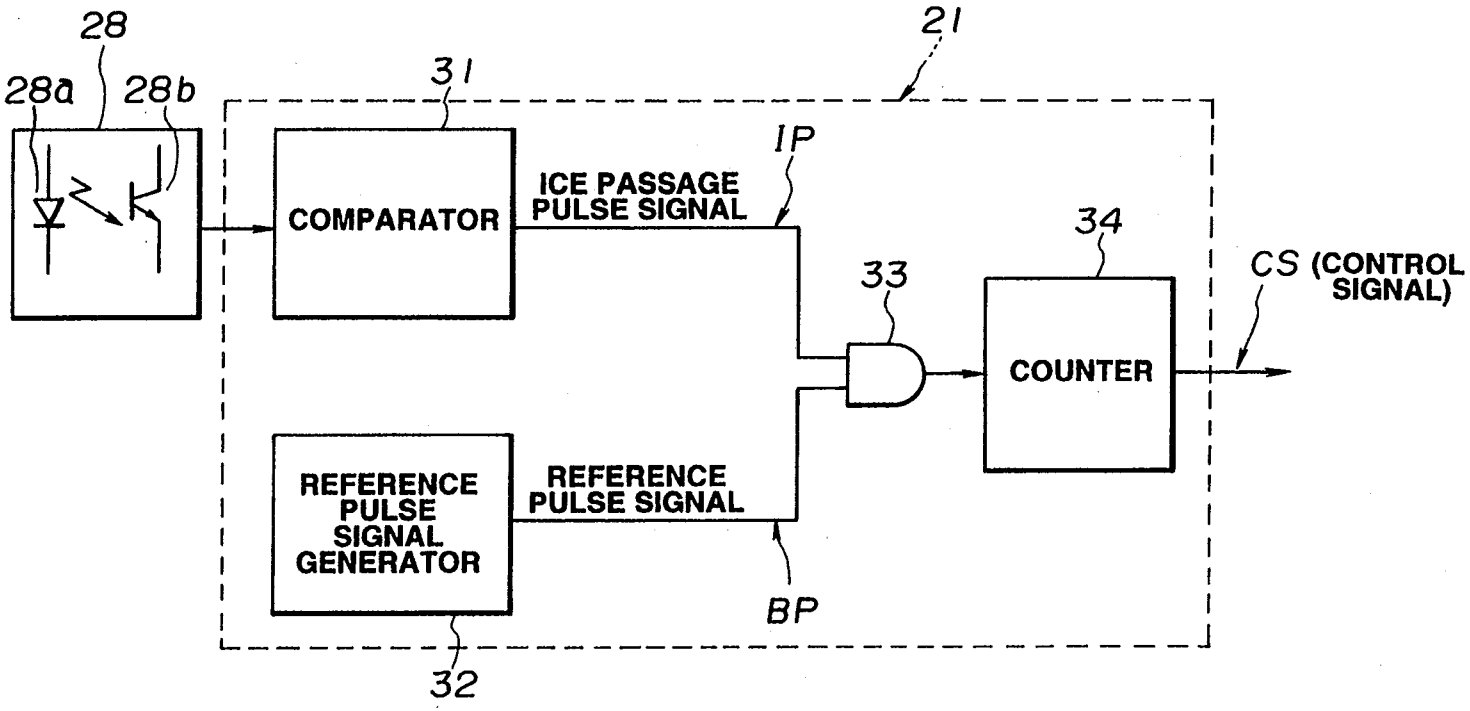
FIG. 2 is a block diagram of the functions of the sensor and the controller in the embodiment shown in FIG. 1.
Figure 3:
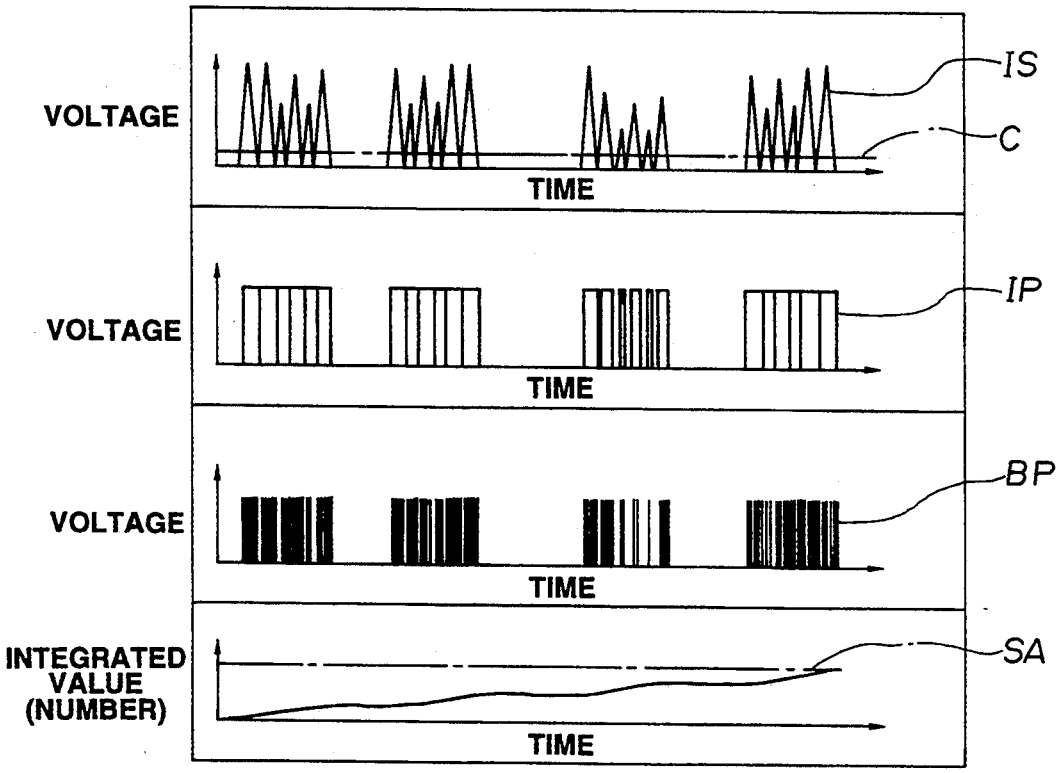
FIG. 3 shows the output voltage of each element shown in FIG. 2.

FIG. 2 is a block diagram of the functions of the sensor 28 and the controller 21, and FIG. 3 shows the output voltage of each element shown in FIG. 2. The sensor 28 outputs a toothlike ice passage signal IS such as those shown at the uppermost portion in FIG. 3 each time an ice chip passes the optical path between the light emitting portion 28*a* and the light receiving portion 28*b*. The ice passage signal IS is input to a comparator 31 of the controller 21 and compared with a threshold value (voltage) C so as to discriminate a noise component. The comparator 31 discriminates the noise component in the ice passage signal IS, and outputs an ice passage pulse signal IP having a width which corresponds to the time during which the voltage is above the threshold value C.

A reference pulse generator 32 of the controller 21 outputs a predetermined reference pulse signal BP. The ice passage pulse signal IP is input to an AND gate 33 together with the reference pulse signal BP, and the maximum number of reference pulse signals that can be accommodated in the width of the pulse signal IP are then input to a counter 34. The counter 34 integrates (counts) the numbers of input reference pulse signals, and when the integrated value reaches a set value SA at which the amount CA of ice discharged is just 100 g, i.e., the required amount, the controller 21 outputs a control signal CS for closing the door 19. The correlation between the set value SA and the amount CA of ice is obtained in advance by experiments.

Owing to the control of the closing operation of the door 19 by the controller 21, even if the amount of ice discharged per unit time is not constant, substantially the required amount, i.e., 100 g of ice is discharged into the cup 1. In addition, since the amount of ice is detected as the number of reference pulse signals BP in this embodiment, digital control is easy, and although measuring the amount of ice takes some time, it is measured with a high degree of accuracy.

Figure 4:
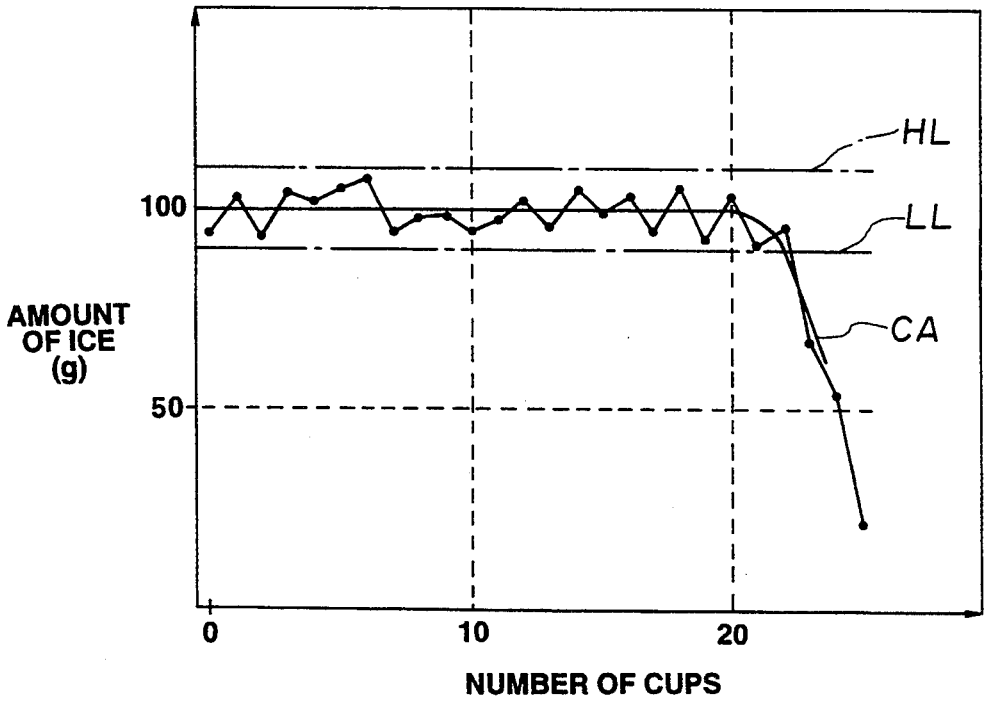
FIG. 4 shows the relationship between the number of cups sold and the amount of ice discharged in an automatic vending machine according to the present invention.
Figure 7:
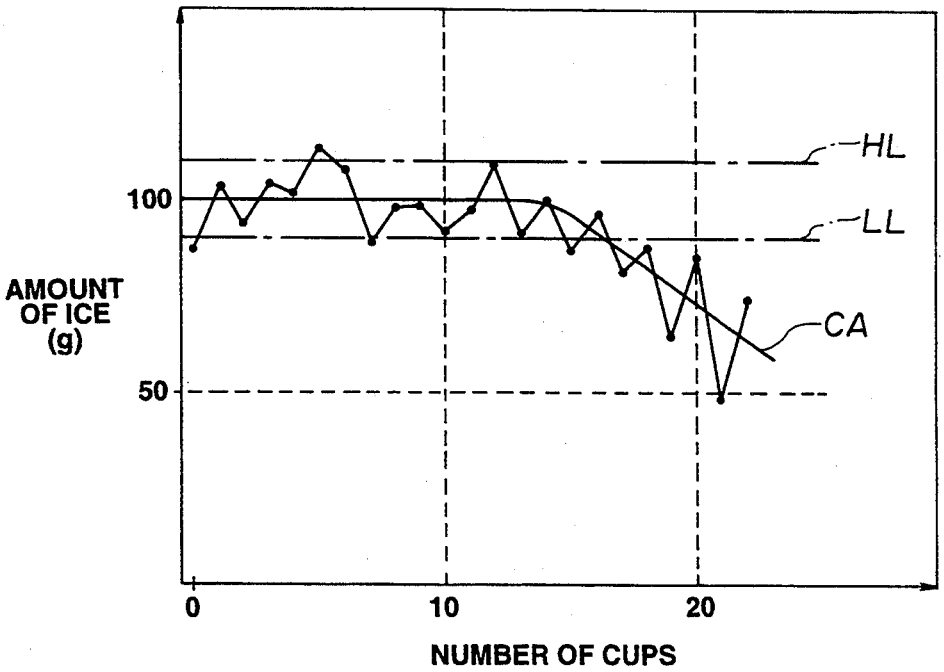
FIG. 7 shows the relationship between the number of cups sold and the amount of ice discharged in a conventional automatic vending machine.

FIG. 4 shows the relationship between the number of cups 1 sold and the amount of ice discharged in an automatic vending machine of the present invention. Cups of drink are continuously sold in the same way as in FIG. 7, and the amount of ice discharged into each cup is plotted. The target value of the amount of ice is 100 g, which is the required amount, and the symbol HL represents the allowable upper limit, LL the allowable lower limit and CA the center value of the amount of ice plotted.

As is clear from FIG. 4, according to an automatic vending machine of the present invention, although there is a slight variation, the amount of ice discharged at each sale is constantly between the allowable upper limit HL and the allowable lower limit LL. Although the amount of ice is decreased after twelve cups of drink are sold in FIG. 7, the amount of ice discharged is approximately constant until more than twenty cups are sold in the present invention.

Since the ice making performance is the same, the amount of ice stored in the storage tank 17 is decreased with the increase in the number of cups sold. The amount of ice discharged per unit time is also decreased, so that, in the present invention, the controller 21 keeps the door 19 open for a longer time than at the initial stage with the increase of the number of cups sold until the amount of ice passing through the ice chute 27 reaches the required amount. When the time for which the door 19 is open reaches the limit value, e.g., 8 seconds (the door opens for 4 seconds in a standard state), the controller 21 judges that ice is in short supply and, for example, stops selling.

In this manner, according to the present invention, since the variation of the amount of ice discharged from the ice making machine 7 at each sale is very small and it is possible to maintain a constant amount of ice for a comparatively long time even when cups of drink are continuously sold, the drink has a stably good taste and selling of a large number of cups of drink is enabled.

In addition, since the amount of ice dropping through the ice chute 27 is detected, it is not necessary to stop the flow of ice, so that the measurement of ice exerts no deleterious influence on the selling time. Since this structure is realized merely by attaching the sensor 28 to the ice chute 27 of a conventional machine, the automatic vending machine of the present invention can be manufactured with a good mass productivity.

Figure 5:
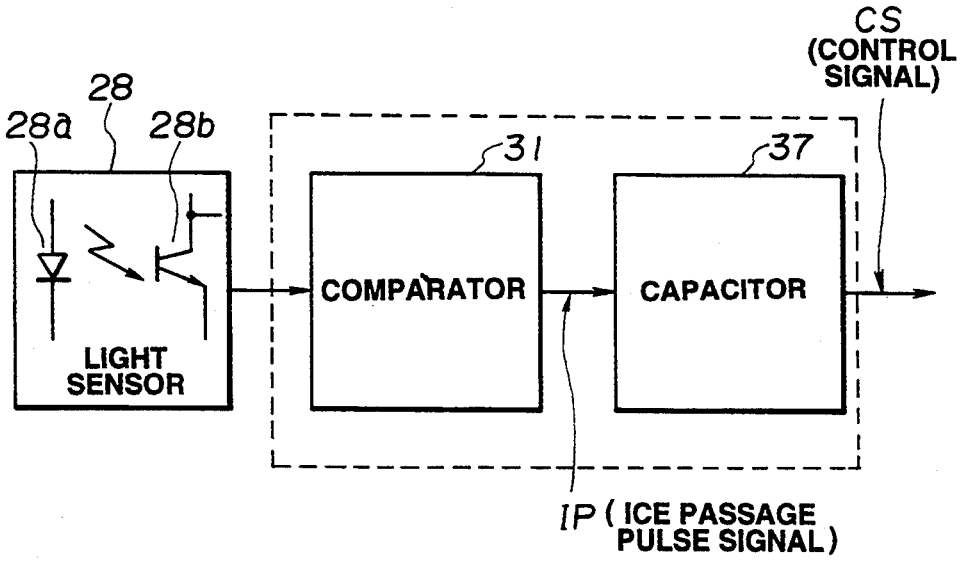
FIG. 5 is a block diagram of the functions of the sensor and the controller in another embodiment of an automatic vending machine according to the present invention.
Figure 6:
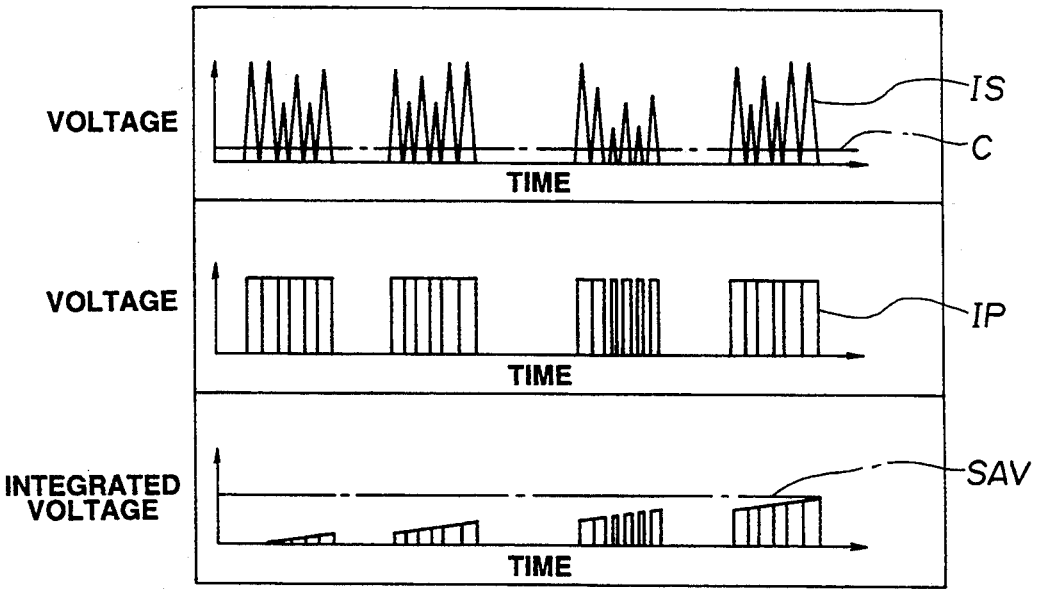
FIG. 6 shows the output voltage of each element shown in FIG. 5.

FIG. 5 is a block diagram of the functions of the sensor 28 and the controller 21 in another embodiment of an automatic vending machine according to the present invention, and FIG. 6 shows the output voltage of each element shown in FIG. 5. The same reference numerals in FIGS. 5 and 6 as those in FIGS. 2 and 3 represent the same elements as those in FIGS. 2 and 3.

In this embodiment, the sensor 28 also outputs a toothlike ice passage signal IS such as one shown at the uppermost portion in FIG. 3 each time an ice chip passes the optical path between the light emitting portion 28*a* and the light receiving portion 28*b*. The ice passage signal IS is input to a comparator 31 of the controller 21 and compared with the threshold value (voltage) C so at to discriminate a noise component. The comparator 31 discriminates the noise component in the ice passage signal IS, and outputs an ice passage pulse signal IP having a width which corresponds to the time during which the voltage is above the threshold value C.

The pulse signal IP is input to a capacitor 37 of the controller 21 and charged (integrated) . When the integrated value reaches a set value SAV at which the amount CA of ice discharged is just 100 g, i.e., the required amount, the controller 21 outputs the control signal CS for closing the door 19. The correlation between the set value SAV and the amount CA of ice is obtained in advance by experiments.

Owing to the control of the closing operation of the door 19 by the controller 21, even if the amount of ice discharged per unit time is not constant, substantially the required amount, i.e., 100 g of ice is discharged into the cup 1. In addition, since the controller 21 is composed of the comparator 31 and a charging apparatus such as the capacitor 37 in this embodiment, the controller 21 can be produced at a low cost.

As described above, according to the present invention, since the ice discharging operation of the ice making machine is controlled on the basis of the ice passage signal IS output from the sensor 28 which detects the ice passing through the ice chute 27, even if the amount of ice discharged per unit time is not constant, it is possible to constantly put the required amount of ice into the cup 1. Therefore, the drink has a stably good taste and selling of a large number of cups of drink is enabled.

In addition, since the amount of ice passing (dropping) through the ice chute 27 is detected, it is not necessary to stop the flow of ice, so that the measurement of ice exerts no deleterious influence on the selling time. In this way, it is possible to sell a drink in a cup with rapidity and stability.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An automatic vending machine for supplying a drink in a cup comprising:

ice making means for making ice;

an ice chute into which ice is discharged from said ice making means and through which the ice passes for feeding into the cup;

a sensor for detecting the ice passing through said ice chute and creating an ice passage signal in response thereto; and a controller operatively connected to said sensor for determining the amount of ice fed to the cup and controlling the feeding of ice to the cup on the basis of said ice passage signal.

2. Apparatus as in claim 1 further comprising means for detecting the amount of ice discharged from said ice making means and stopping the ice discharged when the amount reaches a predetermined amount.

3. An automatic vending machine according to claim 1, wherein said ice making means includes a cooling means, a cistern, a cylindrical cooling container which is cooled by said cooling means and into which water for making ice is supplied from said cistern, a motor for rotating an auger in said cooling container, and an ice storage tank at an upper end of said ice making means, wherein an ice layer is produced on an inner surface of said cooling container which layer may be scraped upward by said auger and which may be compressed to produce ice chips which can be stored in said storage tank in a predetermined amount.

4. An automatic vending machine according to claim 1, wherein said sensor comprises a light sensor including a light emitting portion and a light receiving portion attached to said ice chute so as to form an optical path, said sensor producing the ice passage signal as a change in an output voltage of said light receiving portion in response to ice passing through said ice chute and crossing the optical path between said light emitting portion and said light receiving portion.

5. An automatic vending machine according to claim 1, wherein said controller further includes means for discriminating against a noise component in said ice passage signal to generate an ice passage pulse signal, means for generating reference pulse signals and means for detecting the amount of ice by counting the number of reference pulse signals that can be accommodated in the width of said ice passage pulse signal.

6. An automatic vending machine according to claim 1, wherein said controller further includes means for discriminating against a noise component in said ice passage signal to generate an ice passage pulse signal, means for applying said ice passage pulse signal to a capacitor to charge the capacitor to a capacitor voltage charge, and means for detecting the amount of ice based upon the capacitor voltage charge.

7. Apparatus as in claim 1 wherein the feeding of the ice to the cup is controlled by controlling the discharge of ice from said ice making means into said chute.

8. An automatic vending machine according to claim 7 wherein said controller stops the discharging of ice from said ice making means when the amount of ice discharged from said ice making means reaches a predetermined amount.

9. An automatic vending machine for supplying a drink in a cup comprising:

ice making means for making ice and selectively discharging the ice in a discharging operation;

an ice chute into which ice is discharged from said ice making means and through which the ice passes to be supplied into the cup;

a sensor for detecting the ice passing through said ice chute and creating an ice passage signal in response thereto; and a controller for starting the ice discharging operation of said ice making means, producing an ice passage pulse signal on the basis of said ice passage signal created by said sensor, determining the amount of ice discharged from said ice making means by integrating the ice passage pulse signal, and stopping the discharging operation of said ice making means when said amount of discharged ice reaches a predetermined amount.

* * * * *